United States Patent [19]

Bolton et al.

[11] Patent Number: 4,499,816

[45] Date of Patent: Feb. 19, 1985

[54] DISCHARGE AIR ASSEMBLY FOR A ROOM AIR CONDITIONER

[75] Inventors: Theodore S. Bolton, Liverpool; Brad G. Leech, Fayetteville; Richard D. Lang, Chittenango, all of N.Y.

[73] Assignee: Carrier Corporation, Syracuse, N.Y.

[21] Appl. No.: 477,547

[22] Filed: Mar. 21, 1983

[51] Int. Cl.[3] ..... F24F 13/15

[52] U.S. Cl. ..... 98/40.26

[58] Field of Search ..... 98/40 V, 40 VM, 94 AC, 98/110, 121 A

[56] References Cited

U.S. PATENT DOCUMENTS

| | | | |
|---|---|---|---|
| 2,565,836 | 8/1951 | Alt | 98/121 |
| 2,948,211 | 8/1960 | Melgaard | 98/110 X |
| 3,045,578 | 7/1962 | McGrath | 98/40 |
| 3,789,619 | 2/1974 | Kincaid et al. | 62/262 |
| 4,009,648 | 3/1977 | Braden et al. | 93/40 V |
| 4,307,579 | 12/1981 | Bolton | 62/262 |

FOREIGN PATENT DOCUMENTS

| | | | |
|---|---|---|---|
| 2367990 | 5/1978 | France | 98/40 VM |

*Primary Examiner*—Harold Joyce

*Attorney, Agent, or Firm*—Robert H. Kelly

[57] ABSTRACT

A discharge air assembly for use in a room air conditioning unit is disclosed. The discharge air assembly includes both horizontal and vertical louvers for directing the air being discharged in any direction. The horizontal louvers are mounted in V-shaped slots defined by a vertical support member and are secured thereto by a louver retainer which via frictional fit maintains the louvers in the desired position. Additionally, control knobs mounted for sliding displacement are utilized to effect rotational displacement of the vertical air deflectors. The entire assembly is arranged as a subassembly which can be mounted with any room air unit having a discharge opening of a selected size.

8 Claims, 3 Drawing Figures

DISCHARGE AIR ASSEMBLY FOR A ROOM AIR CONDITIONER

BACKGROUND OF THE INVENTION

1. Field of the Invention

This invention relates to assemblies for directing air being discharged from an opening. Specifically, the invention concerns the utilization of vertical and horizontal louvers in a room air conditioning unit to control the direction of the air being discharged from the unit.

2. Description of the Prior Art

Residential air conditioning units of the type which extend through the wall of a residence or are mounted in a window typically include a discharge port for discharging conditioned air from the unit into the space to be conditioned. Louvers have been provided to direct the air being discharged in the manner desired. Additionally, rotating doors have been mounted to cover the discharge area, said doors opening a predetermined amount from the force of the air being circulated through the unit.

The effective control of air being discharged through the discharge opening in both the horizontal and vertical directions has previously involved the utilization of numerous components and complex assemblies to achieve the desired effect. The present device utilizes a retainer to maintain horizontal louvers in position such that pivot pins and openings to retain the pivot pins for rotational displacement of the horizontal louvers are eliminated.

It has additionally been found that to effect rotational movement of the vertical louvers or air guides that a sliding control is particularly user effective. The herein application discloses a sliding control coacting with air guides to effect side to side displacement of the air.

Since any assembly involving both horizontal and vertical deflection of air contains numerous parts and is somewhat complex, it has additionally been found advantageous to build the entire assembly as a subassembly capable of being mated with other components. Specifically, by building an entire subassembly, the subassembly may be mounted to various type and sized grilles designed for a variety of air conditioning units. The grille may be sized to each unit while the discharge opening is maintained a standardized size.

SUMMARY OF THE INVENTION

It is an object of the present invention to provide a discharge air assembly for directing air being circulated through an opening.

It is a further object of the present invention to provide means for deflecting air both upwardly and downwardly and from side to side in a single assembly.

It is a further object of the present invention to provide a subassembly for use in directing air from the discharge opening of an air conditioning unit suitable for being mounted in various sized units.

Another object of the present invention is to provide horizontal louvers capable of being maintained in pivotal engagement with slots without utilizing pivot pins and corresponding pin receiving openings in the louver.

A yet further object of the present invention is to provide a louver retainer for maintaining louvers in contact with a vertical support throughout their rotational displacement while simultaneously maintaining the louvers in a selected rotational position via frictional forces.

Another object of the present invention is to provide a safe, economical and reliable assembly including both horizontal and vertical louvers.

A further object of the present invention is to provide an assembly which is economical to manufacture and easy to assemble in a room air conditioning unit.

Other objects will be apparent from the description to follow and from the appended claims.

The foregoing objects are achieved according to a preferred embodiment of the invention by the provision of an assembly for directing air being discharged from an opening in an air conditioning unit. The assembly includes vertically extending supports defining spaced V-shaped slots on one edge and arcuate guide surfaces on the opposite edge. A series of horizontally extending and rotatable louvers are located to extend across at least a portion of the opening for directing the air flowing through the opening either upwardly, downwardly or passing without change, said louvers defining a louver slot extending from an edge of the louver inwardly to a slot base, said louvers being positioned such that the vertical support extends through the louver slot and the louver slot base contacts the vertical support at the V-shaped vertical support slot. At least one louver retainer including means connecting the retainer to each louver to maintain the louvers in position relative to the vertical support is included. Each louver retainer comprises a guide boss contacting the arcuate guide surface in the vertical support such that upon rotation of one louver all louvers are rotated and maintained generally parallel by displacement of the louver retainer. Additionally, all louvers are maintained in contact with the louver support by the louver retainer since the louver retainer is displaced along an arcuate path defined by contact between the guide boss and the guide surface.

The assembly additionally includes the louver retainer forming a frictional fit with the vertical support for maintaining the louvers in the desired position. The louver retainer may include a series of projecting fingers, at least one extending on the opposite side of the louver support from the others to create the frictional fit.

Vertical louvers or air guides may further be provided and mounted in pivotal engagement with the assembly. A sliding control knob may coact with an extension from a vertical louver to create rotational displacement of the louver via sliding displacement of the control knob. Additionally, the assembly may include a circumferentially extending frame defining areas between which the vertical support members extend, between which the horizontal rotatable louvers extend and defining pivot openings into which a pivoting means extending from the vertical louvers may be engaged.

DESCRIPTION OF THE PREFERRED EMBODIMENT

The present invention provides a relatively non-complex vertical and horizontal louver arrangement for controlling air being discharged through an opening. The specific application described for this louver arrangement is in a room air conditioning unit. It is to be understood that this assembly may be utilized in other openings wherein similar air directing surfaces are required.

Figure 1:
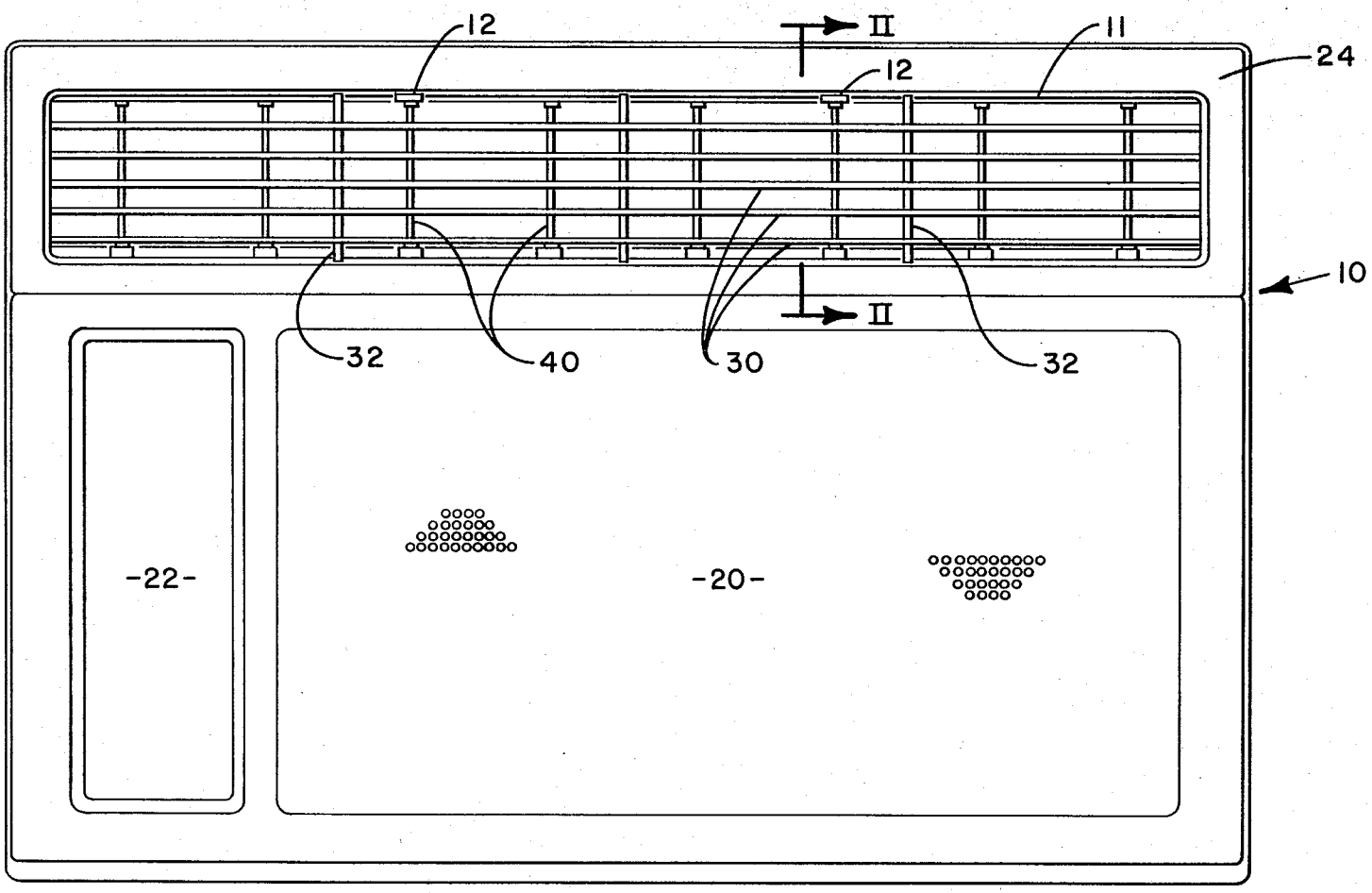
FIG. 1 is a front view of a grille of a room air conditioning unit.

Referring now to FIG. 1 there may be seen a front view of a grille of a room air conditioning unit. Grille 10 is shown having an inlet area 20 including a myriad of small openings (only a few are shown for clarity) for allowing air to enter the unit. Controls area 22 is shown wherein a door may be mounted over the controls for the air conditioning unit. At the top of grille 10 is shown a discharge perimeter 24 which defines an opening into which louver assembly 11 is mounted. The louver assembly 11 as seen in FIG. 1 includes vertical louver supports 32, vertical air guides 40, horizontal louvers 30 and control knobs 12.

As may be seen in FIG. 1, the entire louver assembly may be physically removed from the grille such that the discharge perimeter 24 merely defines a discharge opening. The louver assembly including both the vertical air guides and horizontal louvers and all the components maintaining them in position is thereafter assembled to the opening to provide directional control of the air being discharged therethrough.

Figure 2:
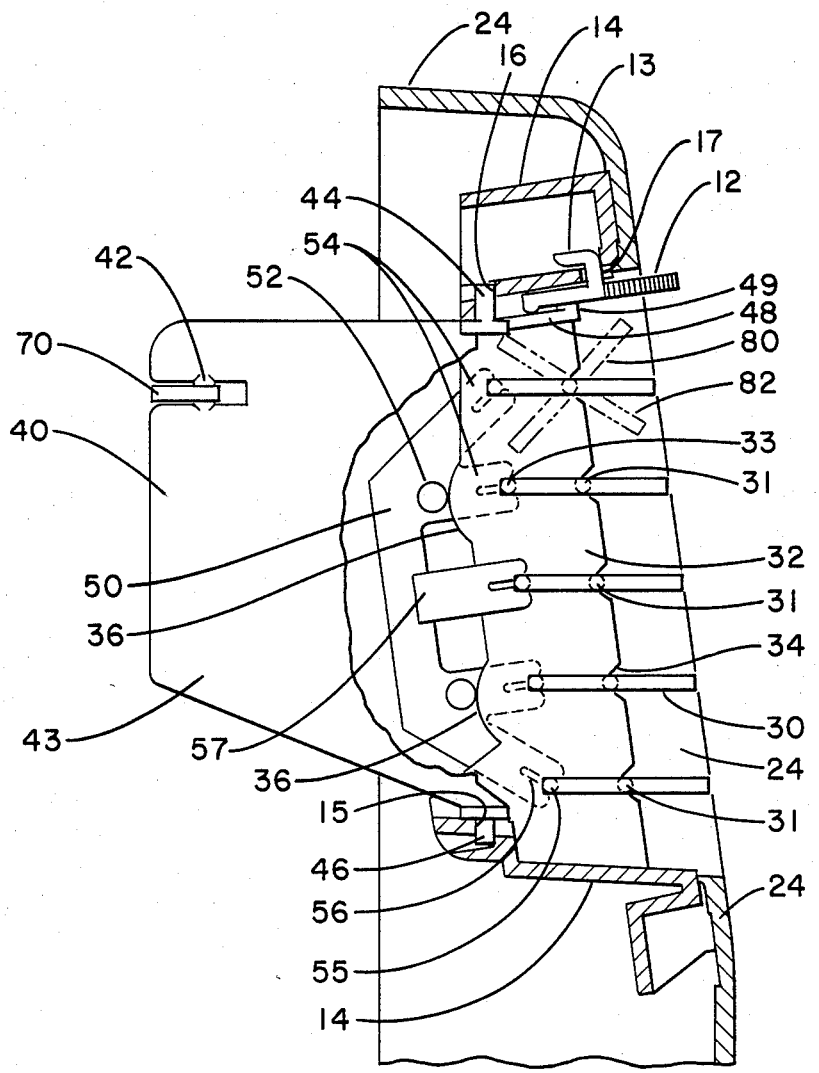
FIG. 2 is a sectional view taken along line II—II of FIG. 1 showing the discharge air assembly.

Referring now to FIG. 2, there may be seen a partial sectional side view of the louver assembly. Discharge perimeter 24 is shown at the top and bottom of FIG. 2. Additionally, frame 14 is shown defining the outer limits of the louver assembly and is shown abutting against the back side of discharge perimeter 24 of the grille. Horizontal louvers 30 are shown mounted for pivotal rotation within V-shaped slots 34 which define a pivot area 31 wherein a portion of louver 30 contacts the vertical support. As is shown in phantom at the uppermost louver, an upward deflection position 80 and a downward deflection position 82 are indicated to reflect the louver being displaced to direct the air either upwardly or downwardly.

Vertical support 32 is shown extending from the bottom of frame 14 to the top of frame 14 and defines spaced pivot slots 34. Vertical support 32 further defines arcuate guide surfaces 36 on the opposite edge from the edge defining pivot slots 34.

Louver retainer 50 is shown having a series of extending fingers including retainer fingers 54 and middle finger 57. Each finger extends inwardly and engages a rotation pin 33 extending within a slot defined in the louver. Each finger includes a retainer slot 56 including a rotation pin receiving opening 55. The retainer slot of the finger is displaced upon assembly such that rotation pins 33 of the louvers are engaged within the rotation pin receiving openings 55 to secure each louver to the louver retainer. Guide bosses 52 are shown extending from the louver retainer in contact with arcuate guide surfaces 36 of the vertical support member. The louver retainer acts to engage the pivot pin of the louvers and to secure the louvers against the pivot area of the V-shaped opening in the louver support to maintain the louvers in position. As a louver is rotated the louver acts to displace the louver retainer which acts to displace the remaining louvers such that all louvers rotate simultaneously and are maintained parallel to each other. However, as the louver retainer is displaced, the rotational displacement of the louver affects the distance the louver extends inwardly from the V-shaped slot. Hence, the louver retainer must also effectively move such that the horizontal distance between the V-shaped slot and the louver retainer changes. The interaction between the guide boss 52 and the arcuate guide surface 36 allows the louver retainer to be displaced inwardly (to the left in FIG. 2) and outwardly (to the right in FIG. 2) as the louvers rotate while maintaining the louvers in the desired position abutting the pivot area of the V-shaped slots. Hence, not only does the louver retainer act to gang the louvers together such that as one is displaced all are displaced but also acts to maintain the louver secured in the V-shaped slot for rotational displacement notwithstanding the rotational position of the louver via the interaction between the guide bosses and the guide surfaces.

Vertical air guide 40 is shown having an air guide surface 43 extending inwardly. Mounted to the air guide surface is top pin 44 and bottom pin 46. The top pin 44 extends into pin opening 16 in frame 14 and bottom pin 46 extends into pin opening 15 in the bottom portion of frame 14. Hence, the air guide is mounted for rotational displacement about the two pins. Gang bar 70 is shown connected to vertical air unit pin 42 such that each of the individual air guides is ganged together to effect common displacement therebetween. Extending from top pin 44 in the opposite direction from the air deflection surface 43 is air guide extension 48. Air guide extension 48 includes an extension control pin 49 extending upwardly. Control knob 12 is shown mounted for sliding displacement relative to control knob opening 17. Control knob extension 13 extends through opening 17 and maintains the knob in position for sliding displacement. Extension control pin 49 extends upwardly from the control arm into an opening defined by the control knob such that sliding displacement of the control knob effects rotational displacement of the air guide 40 by translating the extension control pin such that it rotates relative to top pin 44.

Figure 3:
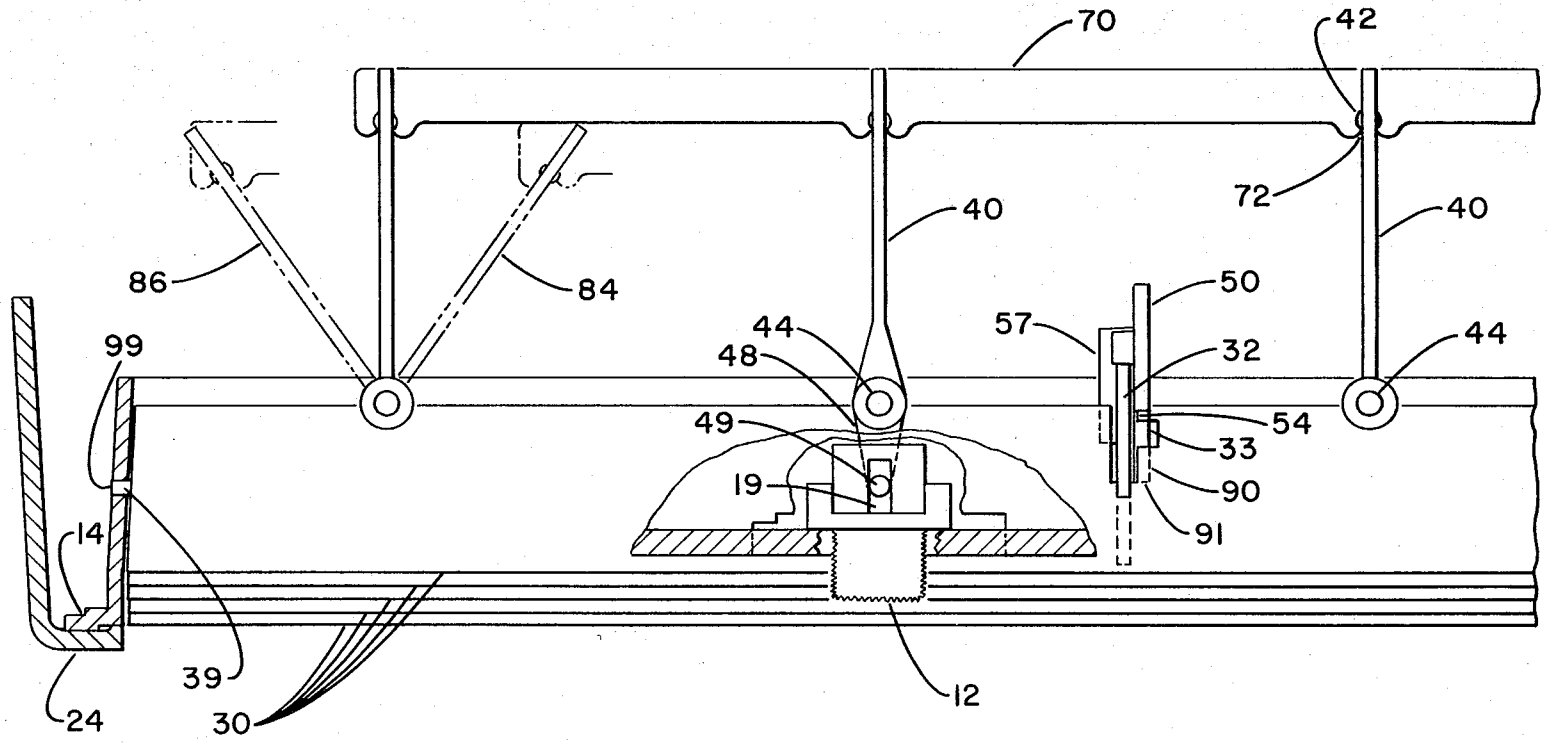
FIG. 3 is a top partially cutaway view of a portion of the discharge air assembly.

Referring now to FIG. 3 there may be seen a top view of the discharge air assembly. Gang bar 70 is shown connecting each of the vertical air guide surfaces 40 and includes a gang bar pin receiving opening 72 into which vertical air guide pins 42 are mounted in a snap fit arrangement. It may be seen that displacement of any vertical air guide results in like displacement of the other vertical air guides. Drawn in phantom are air guides 84 and 86 showing potential displacements of the vertical air guides in the left and right directions.

Additionally, it may be seen that control knob 12 is shown mounted for sliding displacement to either the left or right as shown in FIG. 3. Pivot pin 44 is shown having pivot pin extension 48 extending towards the control knob therefrom and having extension control pin 49 extending upwardly. Control knob slot 19 into which the extension control pin 49 extends is defined by a portion of control knob 12. Hence, it may be seen, that as the control knob is displaced in either the left or right directions pin 49 is also displaced in the left or right directions and may slide in the control knob slot forwardly and backwardly. This arrangement is provided since the extension pin will rotate about pivot pin 44 whereas the control knob slides in a linear motion. Hence, sliding displacement of the control knob will effect rotational displacement of extension pin 49 which will cause air guide 40 to be displaced.

It may additionally be seen in FIG. 3 that various horizontal louvers 30 are shown extending from frame 14 of the discharge assembly. Additionally, pivot pin 39 is shown mounted in pivot opening 19 to help position the horizontal louvers for rotational movement. Discharge perimeter 24 of the grille is additionally shown.

Shown in top horizontal louver 30 are louver slot 90 extending inwardly from the interior edge of the louver and including louver slot base 91. Additionally, vertical guide surface 32 and middle finger 57 of louver retainer 50 are shown. Pin 33 extending into the louver slot from a louver is shown as is the finger of the louver retainer engaging the pin to maintain the louver within the V-shaped slot of the vertical support. It may further be seen that the middle finger 57 and the remaining fingers of the louver retainer are on opposite sides of the vertical support 32 and are arranged to frictionally engage the vertical support to maintain the louver retainer and the horizontal louvers in the desired position.

From the above description it is apparent that the assembly provides means for maintaining the louvers in position without providing for specific louver rotational pins and openings for the receipt of those pins. By not using rotational pins, the necessity of a large slot in the louver is avoided. If a rotational pin is used, a slot large enough to allow assembly of the pin into an opening within the louver is required. Additionally, the large slot must be located at the pivot point in the louver. The current arrangement allows for a slot relatively narrow in width to be provided such that the louver may slide over the vertical support. The slot must be slightly larger to allow a pin located towards the back of the slot to project inwardly for engagement with a finger of the louver retainer. However, the overall size of the slot is greatly reduced and the location of the slot is moved towards the back of the louver where it is less obvious when viewing the assembly from the front.

It can be additionally seen from the description that the provision of control knobs which slide from left to right on the front of the unit may be utilized to provide for rotational displacement of the vertical air guides. Hence, a relatively simple and reliable system is provided for both the vertical and horizontal deflection of air being discharged through a discharge opening.

The invention has been described in detail with particular reference to the preferred embodiment thereof but it will be understood that variations and modifications can be effected within the spirit and scope of the invention.

What is claimed is:

1. An assembly for directing air being discharged from an opening in an air conditioning unit which comprises:

vertically extending supports defining spaced V-shaped slots on one edge and arcuate guide surfaces on the opposite edge;

a series of horizontally extending rotatable louvers located to extend across at least a portion of the opening for directing the air flowing through the opening either upwardly, downwardly or passing without change, said louvers defining a louver slot extending from an edge of the louver inwardly to a slot base, said louvers being positioned such that the vertical support extends through the louver slots and the louver slot base contacts the vertical support at the V-shaped vertical support slot; and at least one louver retainer including means connecting the retainer to each louver having a series of projecting fingers, one finger extending to engage each louver and wherein a portion of the fingers engage one side of the louver support and at least one finger engages the opposite side of the louver support to form a frictional engagement between the fingers of the louver retainer and the vertical support to maintain the louvers in position relative to the vertical support, and a guide boss contacting the arcuate guide surface of the vertical support such that upon rotation of one louver all louvers are rotated and maintained generally parallel by displacement of the louver retainer and are maintained in contact with the vertical support since the louver retainer is displaced along an arcuate path defined by contact between the guide boss and the guide surface.

2. The apparatus as set forth in claim 1 wherein each finger defines a rotation pin receiving opening, wherein each louver includes a rotation pin extending within the slot defined by the louver and wherein each rotation pin is maintained within the corresponding rotation receiving opening such that displacement of a louver causes displacement of the louver retainer and other louvers.

3. The apparatus as set forth in claim 1 and further comprising vertically extending air guides including air deflection surfaces pivotally mounted for directing the air flowing through the opening to either side or allowing the air to pass without change in direction.

4. The apparatus as set forth in claim 3 and further comprising:

a gang bar extending between all of the air guides and means to connect the gang bar to each air guide.

5. The apparatus as set forth in claim 3 wherein at least one air guide further comprises an air guide extension projecting from the opposite side of the point where the air guide is pivotally mounted than the air deflection surface; and knob means mounted for sliding displacement, said knob means including engagement means mating with the air guide extension to cause rotation of the air guide upon sliding displacement of the knob means.

6. An air directing assembly for covering an opening which comprises:

a circumferentially extending frame, defining a discharge area;

at least one vertical support member extending vertically across the discharge area from the frame at the bottom to the frame at the top, said support member defining spaced V-shaped slots on one edge and arcuate guide surfaces on the opposite edge;

horizontally extending rotatable louvers located to extend across at least a portion of the discharge opening, said louvers defining a louver slot extending from an edge of the louver inwardly to a slot base, the slot base of each louver mating with the narrow end of the V-shaped slot in the vertical support to serve as a pivot point; and a louver retainer including means connecting the louver retainer to each louver, said means having a series of fingers engaged one to each of the louvers, said fingers extending on opposing sides of the vertical support in frictional engagement therewith, and a guide boss for engaging the arcuate guide surface of the vertical support, said louver retainer securing the louvers to the vertical support and translating rotational movement of one louver to the other louvers.

7. The apparatus as set forth in claim 6 wherein the frame defines pin openings and further comprising:

vertically extending air guides having an air deflection surface and rotation pins for engagement with the pin openings to allow the air guides to rotate; and gang means connecting all the air guides for simultaneous rotational displacement.

8. The apparatus as set forth in claim 7 wherein at least one air guide further comprises an air guide extension projecting in a direction from the pivot point opposite from the distance of the air guide surface; and a control means mounted in sliding engagement with the frame and coacting with the air guide extension such that sliding displacement of the control means effects rotational displacement of the air guides.

* * * * *